US005528913A

United States Patent [19]

Savkar

[11] Patent Number: 5,528,913

[45] Date of Patent: Jun. 25, 1996

[54] WASHING MACHINE WITH SNUBBERS FOR LIMITING UNBALANCED LOAD VIBRATION EXCURSIONS

[75] Inventor: Sudhir D. Savkar, Niskayuna, N.Y.

[73] Assignee: General Electric Company, Schenectady, N.Y.

[21] Appl. No.: 283,726

[22] Filed: Aug. 1, 1994

[51] Int. Cl.[6] ..... D06F 37/20

[52] U.S. Cl. ..... 68/23.3; 68/131; 248/613; 248/610; 248/634

[58] Field of Search ..... 68/23.3, 131; 248/638, 248/594, 613, 634, 610

[56] References Cited

U.S. PATENT DOCUMENTS

| | | | |
|---|---|---|---|
| 2,396,105 | 3/1946 | Kirby | 68/23.3 |
| 2,693,098 | 11/1954 | Young | 68/23.3 |
| 3,494,471 | 2/1970 | Grippo | 68/23.3 |

FOREIGN PATENT DOCUMENTS

| | | | |
|---|---|---|---|
| 63-212400 | 9/1988 | Japan | 68/23.3 |
| 64-64692 | 3/1989 | Japan | 68/23.3 |
| 64-64691 | 3/1989 | Japan | 68/23.3 |
| 475199 | 11/1937 | United Kingdom | 68/23.3 |

*Primary Examiner*—Frankie L. Stinson
*Attorney, Agent, or Firm*—Paul R. Webb, II

[57] ABSTRACT

A plurality of snubbers for a washing machine dampens and isolates unbalanced load excursions by using the positive displacement pumping action of air being forced through an orifice in each snubber. One end of each snubber is attached to the washing machine housing and the other end attached to the tub or mounting platform and has a resilient middle portion sidewall defining a cavity that changes in volume to minimize the effects basket excursions caused by unbalanced loads. The snubber sidewall defines an orifice providing a passageway for egress and ingress of air during the change in volume. The orifice meters air so that the resiliency of the snubber is greater for low frequency excursions than for high frequency excursions to thereby function as a damper for low frequency excursions and as a gas spring for high frequency excursions.

20 Claims, 2 Drawing Sheets

WASHING MACHINE WITH SNUBBERS FOR LIMITING UNBALANCED LOAD VIBRATION EXCURSIONS

TECHNICAL FIELD OF THE INVENTION

The present invention relates generally to a washing machine, and, more particularly, to vibration and noise reducing suspension system for a clothes washer.

BACKGROUND OF THE INVENTION

During operation of a washing machine, an unbalanced load of clothes or other articles may cause the basket to spin or rotate off-axis and may cause the tub containing the basket to vibrate. The vibration excursions tend to be especially acute during the start of the spin cycle. At the beginning of the spin cycle, the excursions may become large enough, as the machine passes through resonance of the suspension, for the tub to bang against the washer housing. Accordingly, it would be highly desirable to have a vibration damper that is responsive to the low frequency, high magnitude=excursions normally present at the beginning of the spin cycle to minimize the excursions.

As the washer spin cycle progresses, the rotational speed of the basket increases, and the excursions tend to be limited because the clothes redistribute themselves and because the machine is operating above the resonant speed of the suspension. Stiffening the suspension will keep the tub aligned, but permanently stiffening the suspension will increase the suspension frequency causing the machine to pass through resonance at a higher, more damaging, speed. Accordingly, it would be highly desirable to have a vibration damper that limits the excursions and/or temporarily stiffens the washer suspension to keep the tub aligned.

SUMMARY OF THE INVENTION

The present invention is directed to overcoming one or more of the problems set forth above. Briefly summarized, according to one aspect of the invention, a washing machine comprises a housing, a mounting platform within the housing, a tub having a vertical axis and mounted on the platform within the housing, a basket in the tub for holding articles to be washed, apparatus for rotating the basket, and a plurality of snubbers, each snubber having one end attached to the housing and the other end attached to the tub, mounting platform or at some position along the rods used in rod and spring suspension. Each snubber has a resilient middle portion sidewall defining a cavity that changes in volume to minimize the effects of basket excursions caused by unbalanced loads.

The snubber sidewall defines an orifice providing a passageway for egress and ingress of air from the cavity during the change in volume. The orifice meters air so that the resiliency of the snubber is greater for low frequency excursions than for high frequency excursions to thereby function as a damper for low frequency excursions and as a gas spring for high frequency excursions.

The snubber dampens and isolates the unbalanced load excursions by using the positive displacement pumping action of air being forced through the orifice. The snubber can be a single molded piece which reduces the number of parts required to manufacture a washing machine with related reductions in time and labor.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE PREFERRED EMBODIMENTS

Figure 1:
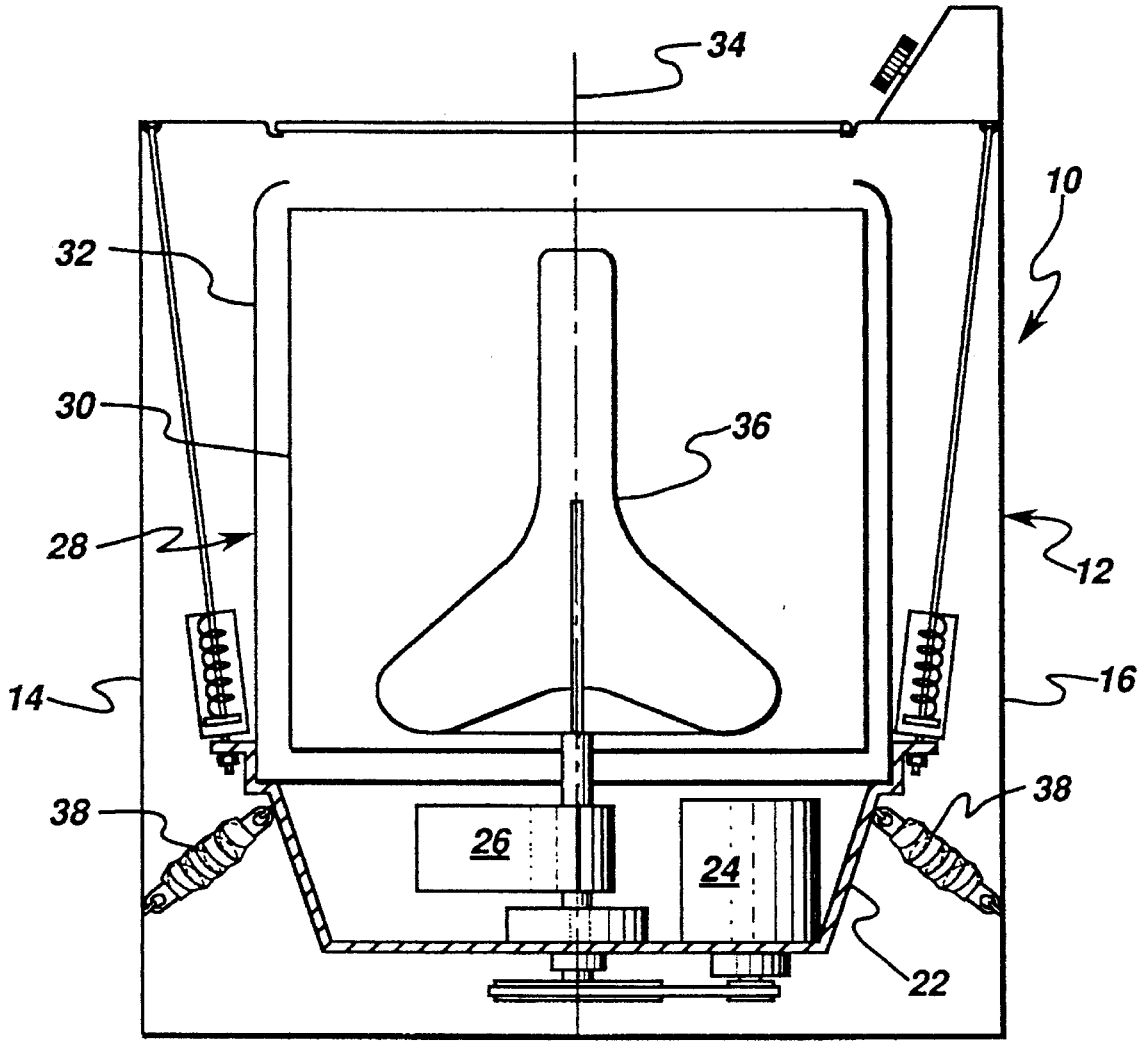
FIG. 1 is a diagrammatic side view of a preferred embodiment of a washer according to the present invention with a right side panel removed to illustrate vibration damping snubbers.
Figure 2:
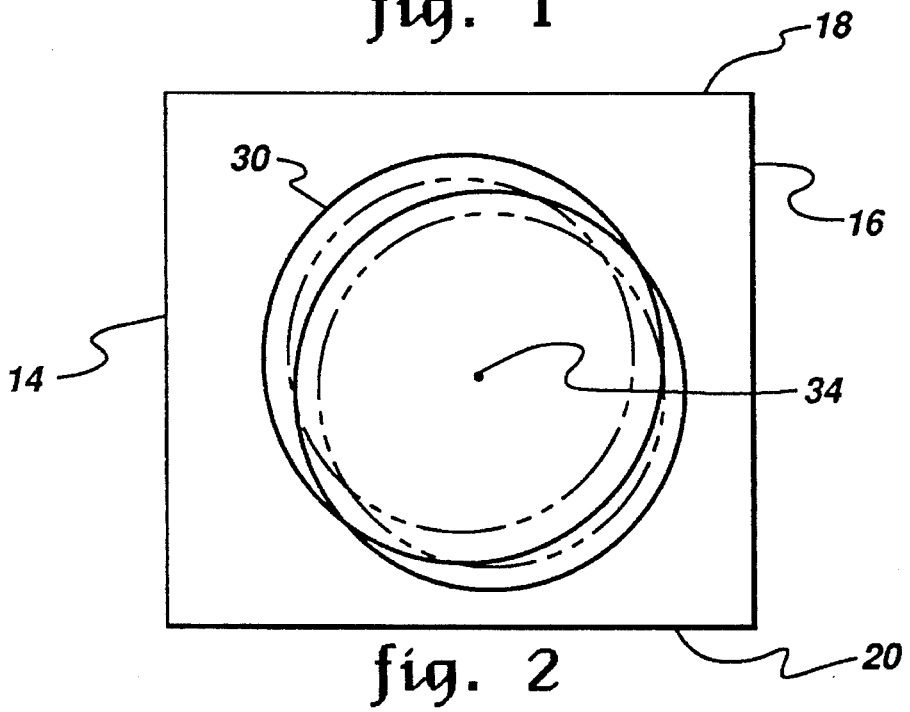
FIG. 2 is a diagrammatic top view of the washer illustrating tub excursions.

Referring to FIGS. 1 and 2, a washing machine 10, for washing a load of articles of clothing and the like, has a housing 12 containing front or rear panels, 14, 16 and left and right panels 18, 20. Typically, one of the front and rear panels 14, 16 is removable for access to the interior mechanisms of the washer 10. Within the housing 10 is a mounting platform 22 with a motor 24, a transmission assembly 26 and a tub assembly 28 mounted thereon. As illustrated, the motor 24 and transmission 26 are positioned on a lower portion of the platform 22 while the tub assembly 28 is mounted on the platform 22 above the motor 24 and transmission 26. As is known in the art, the transmission 26 and wash basket 30 are connected via a shaft. Positioning the transmission 26 on the platform 22 below the tub 28 lowers the center of gravity of the washer 10 which encourages more stable operation.

The tub assembly 28 has a tub 32 with a vertical axis 34 and is positioned on the platform 22 in the housing 12 so that it is spaced from the housing panels 14, 16, 18, 20. The tub assembly 28 contains a basket 30 that is positioned in the tub 32 for holding the articles to be washed. The transmission 26 transfers energy from electric motor 24 or the like (not shown) for operating the basket 30, and an agitator 36 contained therein, during the various cycles of operation of the washer 10.

During a wash cycle, the transmission 26 imparts oscillating motion to the agitator 36.

During a spin cycle, for example, the transmission 26 rotates the basket 30 about the vertical axis 34 in a circular path with the basket 30 remaining vertically upright when the articles to be washed form a balanced load in the basket. When the articles in the basket form an unbalanced load, the basket 30 has a tendency to rotate askew of the vertical axis 34 in a noncircular path with the basket being urged from vertical on excursions. The basket excursions urge the tub 32 from its spaced position relative to the housing panels 14, 16, 18, 20.

At the beginning of a spin cycle, when the load is unbalanced, there may be severe excursions wherein the tub contacts a housing panel. Severe excursions are not only noisy and potentially damaging to the washer, but may cause the washer to move from its position on the floor and walk across the floor, especially where the floor is weak or uneven. For example, as would be experienced on wooden floors of homes. Accordingly, most washers are equipped with a shut down system to turn the machine off when the excursions reach a predetermined magnitude or intensity.

Damping snubbers 38 are provided to help prevent shutdown excursions. A plurality of snubbers 38 are illustrated in FIG. 1. While two snubbers are effective, three snubbers minimize most effectively the basket excursion effects. The three snubbers are positioned 120° apart around the tub 28. If four snubbers are used, they are equally spaced around the tub 28 in a preferred embodiment.

Figure 3:
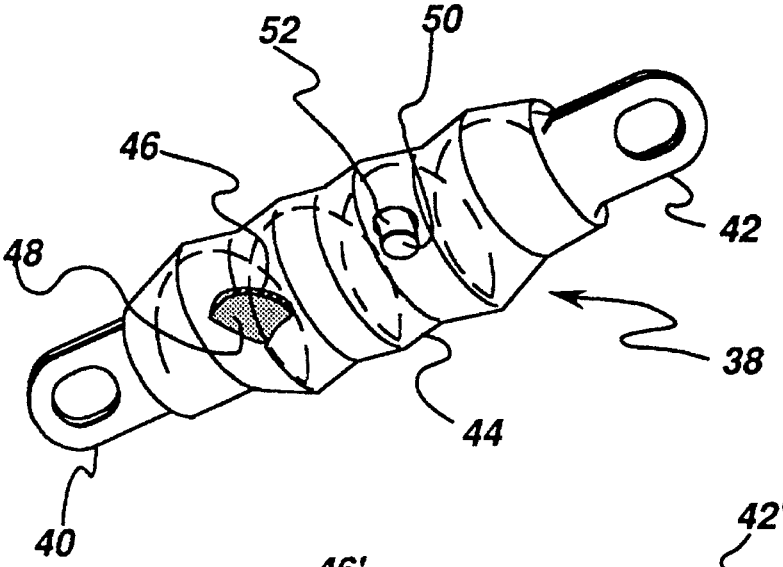
FIG. 3 is a perspective view of one of the snubbers of FIG. 1.

Referring now to FIG. 3, the snubber 38 is a resilient member that has a first end portion 40, a second end portion 42, and a resilient middle portion 44 intermediate the end portions 40, 42. Each end portion 40, 42 has a mounting lug for attachment to one of the housing panels, or to the mounting platform or tub by a nut and bolt or other fastener commonly used by those practiced in the art. As shown in FIG.1, one lug may be joined to one of the panels, and the opposite lug may be joined adjacent to the rod of the rod and spring type suspension the tub assembly 28. The snubber 38 is preferably constructed of a synthetic resinous material that can be molded into the configuration desired, such as polypropylene, for example.

The resilient middle portion 44 of the snubber 38 has a sidewall 46 defining a cavity 48 which changes in volume in response to excursions of a preselected magnitude to thereby minimize the effects of the preselected excursions. When the snubber 38 is to be used as a damper, the sidewall 46 also defines at least one orifice 50 that provides a passageway for ingress and egress of air to the cavity 48 during a change in volume of the first cavity 48 and middle portion 44. The orifice 50 may be eliminated in those applications requiring only stiffening of the suspension. The orifice meters the air so that the resiliency of the snubber middle portion 44 is greater for low frequency excursions than for high frequency excursions to thereby function as damper for low frequency excursions and as a damped gas spring for high frequency excursions. The sidewall 46 may be thickened around the orifice 50 for reinforcement. The orifice may be fitted with or formed with a nipple 52 for directing the air in a preselected direction or to a preselected location, such as to an out of balance load sensor which shuts down the washer during certain conditions.

Preferably, the snubber has a cylindrical configuration with a round cross section and the sidewall has folds, like a fan or like the bellows of an accordion, to easily accommodate the change in volume. The snubber may have a plurality of cavities. A cavity may have multiple orifices, a single orifice, or no orifice at all. Cavities not having an orifice may still change in volume by compressing or expanding the air confined therein. In this mode the cavity acts as a pure gas spring.

Figure 4:
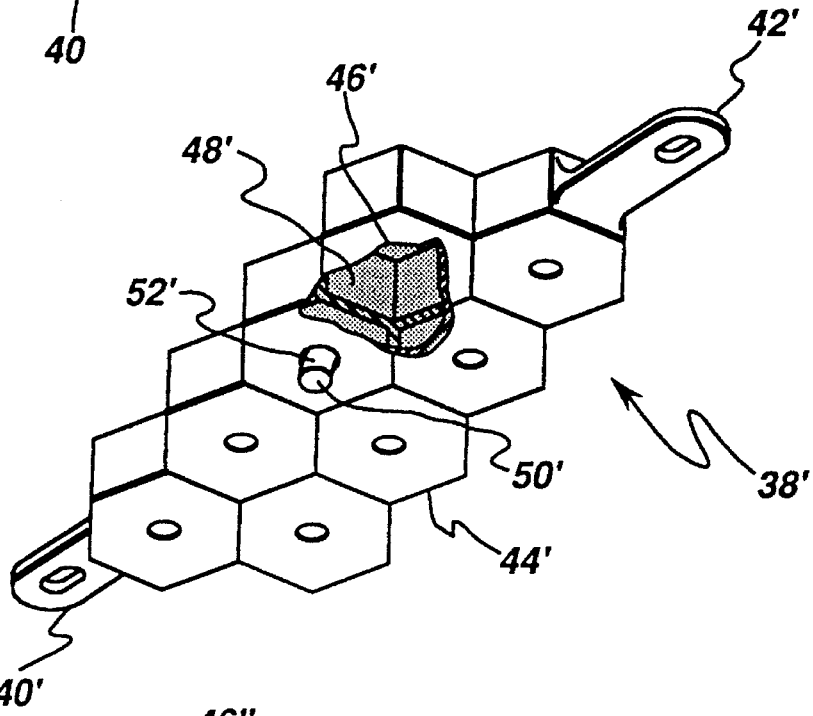
FIG. 4 is a perspective view, similar to FIG. 3, but illustrating another preferred embodiment.

Referring now to FIG. 4, the snubber 38' may have a different configuration than cylindrical as shown in FIG. 3. The snubber 38' may resemble a hexnut or cell of a honeycomb, or may be a cellular configuration other than hexagonal. First and second end portions 40' and 42' have connecting lugs which extend from two of the smaller faces of the nut or cell walls of the honeycomb. A plurality of these cells could be formed as a unitary multicell structure. The resilient middle portion 44' of the snubber 38' has a sidewall 46' defining a cavity 48' which changes in volume in response to excursions of a preselected magnitude to thereby minimize the effects of the preselected excursions. When the snubber 38' is to be used as a damper, the sidewall 46' also defines at least one orifice 50' that provides a passageway for ingress and egress of air to the cavity 48 during a change in volume of the first cavity 48 and middle portion 44'. The orifice 50' may be eliminated in those applications requiring only stiffening of the suspension. The orifice meters the air so that the resiliency of the snubber middle portion 44' is greater for low frequency excursions than for high frequency excursions to thereby function as damper for low frequency excursions and as a gas spring for high frequency excursions. The sidewall 46' may be thickened around the orifice 50' for reinforcement. The orifice may be fitted with or formed with a nipple 52' for directing the air in a preselected direction or to a preselected location, such as to an out of balance load sensor which shuts down the washer during certain conditions.

Figure 5:
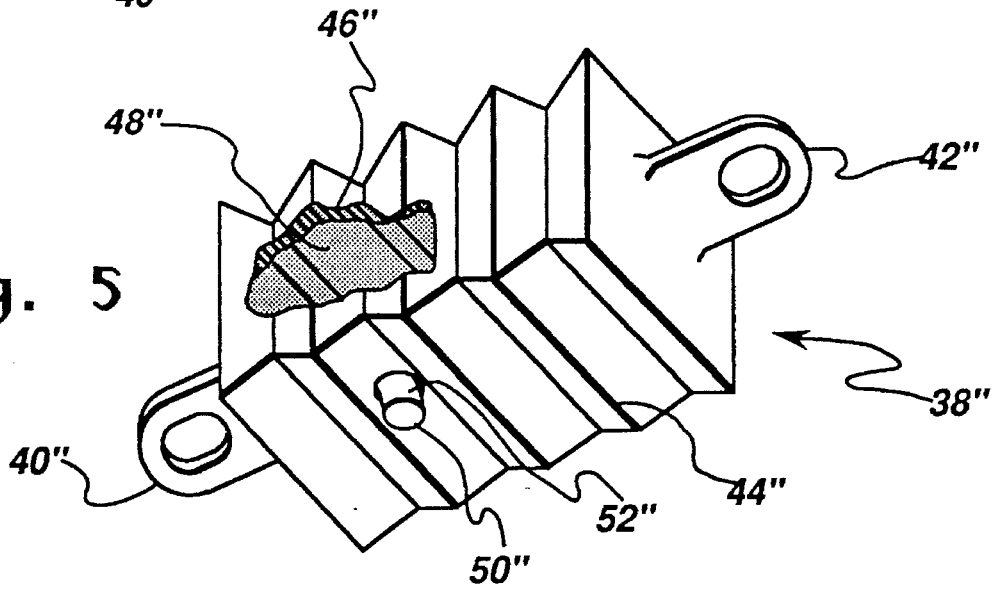
FIG. 5 is a perspective view, similar to FIG. 3, but illustrating another preferred embodiment.

Referring now to FIG. 5, the snubber 38" is a resilient member that has a first end portion 40", a second end portion 42" and a resilient middle portion 44" intermediate the end portions 40", 42", 42" has a mounting lug for attachment to one of the housing panels, or to the mounting platform or tub by a nut and bolt or other fastener commonly used by those practiced in the art. The snubber 38" is preferably constructed of a synthetic resinous material that can be molded into the configuration desired, such as polypropylene, for example.

The resilient middle portion 44" of the snubber 38" has a sidewall 46 defining a cavity 48" which changes in volume in response to excursions of a preselected magnitude to thereby minimize the effects of the preselected excursions. When the snubber 38" is to be used as a damper, the sidewall 46" also defines at least one orifice 50" that provides a passageway for ingress and egress of air to the cavity 48" during a change in volume of the first cavity 48" and middle portion 44". The orifice 50" may be eliminated in those applications requiring only stiffening of the suspension. The orifice meters the air so that the resiliency of the snubber middle portion 44" is greater for low frequency excursions than for high frequency excursions to thereby function as damper for low frequency excursions and as a gas spring for high frequency excursions. The sidewall 46" may be thickened around the orifice 50" for reinforcement. The orifice may be fitted with or formed with a nipple 52" for directing the air in a preselected direction or to a preselected location, such as to an out of balance load sensor which shuts down the washer during certain conditions.

Preferably, the snubber has a box configuration and the sidewall has folds, like a fan or like the bellows of an accordion, to easily accommodate the change in volume.

Operation of the present invention is believed to be apparent from the foregoing description. In response to a large, low frequency tub excursion at the start up of a spin cycle, air in the snubber is free to exit through the orifice as the volume of the cavity decreases to absorb the energy of tile excursion. The excursion is limited by the final volume of the cavity and the rate at which air exits the cavity. Also, the exiting air may be directed through the nipple to an out of balance load sensor to shut down the washer under certain conditions.

In response to a high frequency tub excursion occurring after the start up of the spin cycle, air in the snubber tries to exit through the orifice, but is limited by the size of the orifice. As a result, the volume of the cavity decreases only slightly due to exiting air to absorb the energy of the excursion; thereafter, the pressure of the remaining gas in the cavity increases and the snubber stiffens to keep the tub vertically upright.

While the invention has been described with particular reference to the preferred embodiments, it will be understood by those skilled in the art that various changes may be made and equivalents may be substituted for elements of the preferred embodiments without departing from invention. For example, while the snubber has been described as being constructed of polypropylene, other polymeric materials may be used as well. Also, the snubber may be constructed of metal or composite materials.

As is evident from the foregoing description, certain aspects of the invention are not limited to the particular details of the examples illustrated, and it is therefore contemplated that other modifications and applications will occur to those skilled the art. For example, the snubber has been described with an accordion sidewall and a honeycomb structure, but simple structures with simple compartments are possible and may be preferred in some applications. Also, the sidewall may be cylindrical or boxy or one of numerous other configurations depending upon the particular environment of use. It is accordingly intended that the claims shall cover all such modifications and applications as do not depart from the true spirit and scope of the invention.

What is claimed is:

1. A machine for washing articles, comprising:

a housing having a front panel, rear panel, left panel and right panel;

a mounting platform within said housing;

a tub having a vertical axis and being mounted on said platform within said housing at a position spaced from each of said housing panels;

a basket in said tub having a size sufficient for holding articles to be washed;

an agitator within said basket whose oscillating motion facilitates washing of said articles;

means for imparting oscillating motion to said agitator during a wash cycle, and for rotating said basket during a spin cycle about said vertical axis in a circular path with said basket remaining vertical when said articles form a balanced load in said basket, said basket tending to rotate askew of said vertical axis in a noncircular path with said basket urged from vertical on excursions when said articles form an unbalanced load in said basket, said basket excursions urging said tub from said spaced position relative to said housing panels; and a plurality of one-piece snubbers each having a first end portion attached to one of said housing panels, a second end portion attached to one of said tub and mounting platform, and a resilient middle portion intermediate said end portions, said middle portion having a sidewall defining a first cavity therein which changes in volume in response to predetermined basket excursions to thereby minimize effects of said predetermined basket excursions.

2. A washing machine as set forth in claim 1 wherein the plurality of snubbers comprise three snubbers which are positioned 120° apart around the tub 28.

3. A washing machine as set forth in claim 1 wherein the plurality of snubbers comprises four snubbers which are equally spaced around the tub 28.

4. A washing machine as set forth in claim 1 wherein said snubber sidewall has accordion folds and defines at least one orifice providing a passageway for egress and ingress of air from said first cavity during a change in volume of said snubber middle portion.

5. A washing machine as set forth in claim 4 wherein said at least one orifice meters egress and ingress of air so that the resiliency of said snubber is greater for low frequency excursions than for high frequency excursions to thereby function as a damper for low frequency excursions and as a gas spring for high frequency excursions.

6. A washing machine, as set forth in claim 4 wherein said snubbers sidewall has a nipple in the orifice for directing air from said cavity in a predetermined direction.

7. A washing machine as set forth in claim 1 wherein said snubber sidewall defines a second cavity, said first and second cavities changing in volume in response to predetermined basket excursions to thereby minimize effects of said predetermined basket excursions.

8. A washing machine as set forth in claim 1 wherein said snubber sidewall has honeycomb configuration.

9. A washing machine as set forth in claim 1 wherein said snubber sidewall defines a plurality of cavities in a honeycomb configuration.

10. A washing machine as set forth in claim 1 wherein said snubber sidewall has a boxy configuration.

11. A washing machine as set forth in claim 1 wherein each of said snubbers is attached to the housing on one side and adjacent to the rod of a rod and spring type suspension on the other.

12. A one-piece snubber for mounting a tub to a housing in a washing machine comprising:

a resilient middle portion and opposite first and second end portions for mounting said snubber to said tub and housing; and said middle portion including a sidewall defining a cavity which changes in volume in response to excursions between said tub and housing which in turn move said first and second end portions relative to each other to resiliently distort said middle portion to change said volume.

13. A snubber according to claim 12 wherein said cavity is closed.

14. A snubber according to claim 12 wherein said cavity includes air and an orifice for metering ingress and egress of said air during said change in volume.

15. A snubber according to claim 14 further comprising a nipple at said orifice for directing said air in a preselected direction.

16. A snubber according to claim 14 wherein said sidewall includes folds for accommodating said change in volume.

17. A snubber according to claim 16 wherein said sidewall is in the form of a cylindrical bellows.

18. A snubber according to claim 16 wherein said sidewall is in the form of a honeycomb cell.

19. A snubber according to claim 18 further comprising a plurality of adjoining ones of said honeycomb cells.

20. A snubber according to claim 16 wherein said sidewall is in the form of a box bellows.

* * * * *